US005370421A

United States Patent [19]

Kaiser

[11] Patent Number: 5,370,421

[45] Date of Patent: Dec. 6, 1994

[54] COLORING GREETING CARD

[76] Inventor: Ronald A. Kaiser, 12821 McCracken Rd., Garfield Heights, Ohio 44125

[21] Appl. No.: 243,272

[22] Filed: May 17, 1994

[51] Int. Cl.[5] ..... B42D 15/00

[52] U.S. Cl. ..... 283/117; 40/124.1

[58] Field of Search ..... 283/117; 40/124.1; 446/147, 150; 281/51

[56] References Cited

U.S. PATENT DOCUMENTS 4,404,764 9/1983 Wills et al. ..... 283/117 X 4,613,157 9/1986 Drabish ..... 283/117

5,205,591 4/1993 Lorenz ..... 283/117

*Primary Examiner*—Willmon Fridie

[57] ABSTRACT

A greeting Card having a plurality of surfaces. Sections (pages) are disclosed being unique in that the Greeting Card is personalized by the person, as to color part or all of the Greeting Card. It is designed as to be colorable. Text and/or writing is on the card as well as illustrations and/or drawings and/or cartoons, designed to be colorable.

1 Claim, 1 Drawing Sheet

COLORING GREETING CARD

BACKGROUND OF THE INVENTION

This invention relates to a greeting card; everyone is familiar with greeting cards. The most popular is the type having a first section folded over a second section and covering a message thereon with the first section having a picture printed on its exposed face. Christmas cards are the best example and a common practice is to position received cards to display them. This invention relates to a new and improved Greeting Card, and more particularly to a Greeting Card to add one's personal touch of artwork and expression to this invention wherein one is encouraged to color and/or print the illustrations and/or drawings and/or cartoons. It is designed as to be colorable.

SUMMARY OF THE INVENTION

The present invention relates to a new and improved greeting card. It is designed as to be colorable. It is therefore the object of the present invention to provide a person to add one's personal touch of artwork and expression, whenin one is encouraged to color and/or paint and/or draw on the Greeting Card and/or its' illustrations and/or drawings and/or cartoons and/or its' text and/or its' writing. The Coloring Greeting Card is a Greeting Card every father or mother would be proud to receive if his/her son or daughter colored it. What makes this invention unique and original are the drawings, illustrations, or cartoons which are presented to encourage the person having this invention to color the drawings, illustrations or cartoons thus making the Greeting Card colorful, and add his/her personal touch to it.

BRIEF DESCRIPTION OF THE DRAWINGS

A preferred embodiment of the invention is illustrated in the accompanying drawings of which:

FIG. 1 shows is a perspective view of a typical Coloring Greeting Card in accordance with the invention, front view, with text, and illustration.

FIG. 2 shows is a view with the Coloring Greeting Card opened to show the back of the inner face and the first section and the inner face of the second section exposed, with illustration and writing.

FIG. 3 shows is a view of a Coloring Greeting Card with a plurality of sections (pages); in this example, six surfaces, three sections (pages), with illustration and writing.

FIG. 4 shows is a view of a different style of a Coloring Greeting Card. In this example, one unit with two folds making six sections, the three sections showing have text, and illustrations on them.

FIG. 5 shows is a view of an example of a box of crayons.

FIG. 6 shows is a view of an example of some paints and a paint brush.

DETAILED DESCRIPTION OF THE DRAWINGS

In the preferred embodiments of the invention we will now refer to the drawings.

Figure 1:
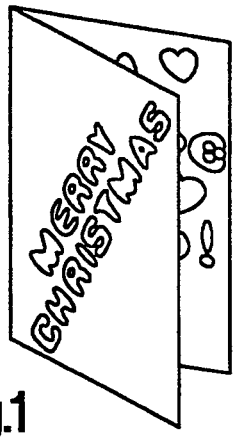
FIG. 1: What

Referring now in particular to FIG. 1, there is an illustration of a typical Coloring Greeting Card showing a front view with writing and illustration it, it is desinged to be colorable having a plurality of surfaces, sections (pages) that may or may not have a plurality of illustrations and/or drawings and/or cartoons on these pages (surfaces). The pages may or may not also have a plurality of text, and/or writing and/or print on these pages (surfaces).

Figure 2:
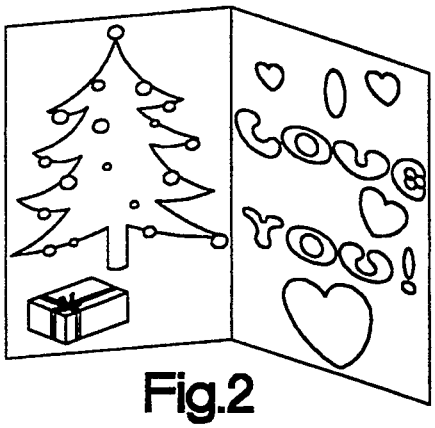
FIG. 2: What

FIG. 2 shows a view of the same Coloring Greeting Card as in FIG. 1, but this view shows the card open as to show the back side of the front section on the left and the front side of the back section to the right. These sections as well as all sections of the invention are desinged to be colorable and as well may or may not have a plurality of illustrations and/or drawings and/or cartoons and/or text andn/or print and/or writing on them.

In the examples of FIG. 1 and FIG. 2, there are a total of four surfaces: Front, Inner Left, Inner Right and Back.

Figure 3:
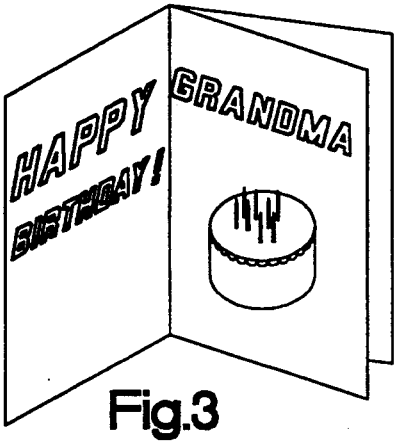
FIG. 3: What

FIG. 3: What FIG. 3 shows is an example of a different style Coloring Greeting Card; in this example, six surfaces. The invention is desinged to be colorable.

Figure 4:
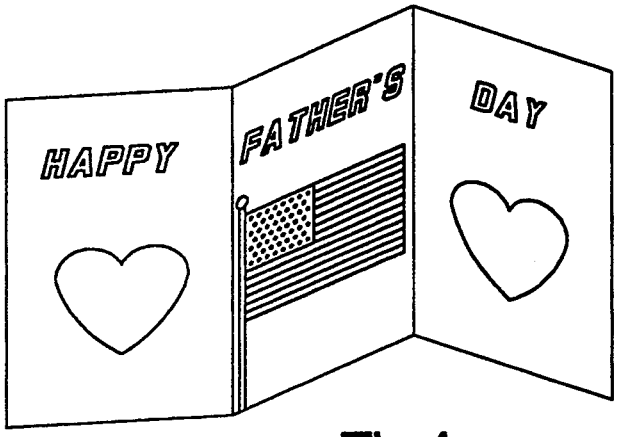
FIG. 4: What

FIG. 4: What FIG. 4 shows is an example of a different style Coloring Greeting Card; in this example, when opened, three surfaces are exposed. As in FIG. 2, two surfaces are exposed.

As shown in FIGS. 2, 3 and 4 dirrerent folds or bends can be used to produce a plurality of surfaces (a plurality of pages). It is desinged to be colorable with illustrations and/or text to the person working on the Coloring Greeting Card can add color and artwork to it.

Figure 5:
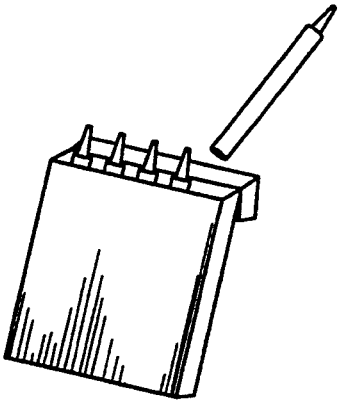
FIG. 5: What

FIG. 5: FIG. 5 shows an example of a plurality of crayons which can be used to color the invention.

Figure 6:
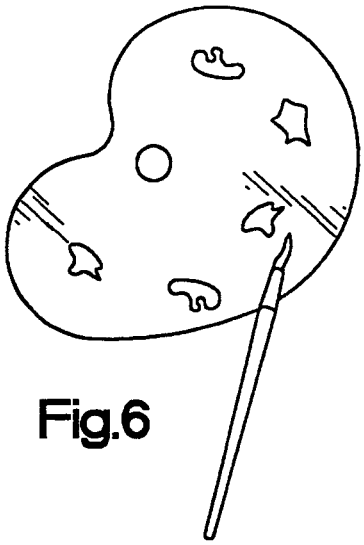
FIG. 6.

FIG. 6: What the figure shows is an example of paints and a paint brush that can to used to color the invention.

Figure 7:
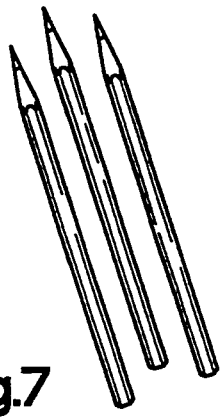
FIG. 7: at FIG. 7 shows is a view of an example of some drawing pencils.

FIG. 7: The figure shows an example of a plurality of drawing pencils that could be used to color the invention.

Thus it is apparent that there has been provided in accordance with the invnetion an improved Greeting Card, and more particularly a Greeting Card which is made to be colored on. While the invention has been described with specific embodiments, thereof, it is evident that many alternatives, modifications and variations will be apparent to those skilled in the art in the light of the foregoing description. Accordingly, it is intended to embrace all such alternatives, modifications, and variations as fall within the spirit and broad scope of the inveniton.

What I claim as my invention:

1. A greeting card system comprising a plurality of generally rectangular cards of a paper-like material, each said card having at least one fold line dividing each said card into at least two sections with front and back surfaces capable of being folded upon each other; said paper-like material having printed thereon artwork and illustrative text defining bomdaries for spatial regions, said spatial regions being devoid of artwork and illustrative text; said greeting card system further comprising a plurality of multi-colored writing utensils, whereby said writing utensils are used to provide color to said spatial regions.

* * * * *